US006256012B1

(12) United States Patent
Devolpi

(10) Patent No.: US 6,256,012 B1
(45) **Date of Patent: *Jul. 3, 2001**

(54) UNINTERRUPTED CURVED DISC POINTING DEVICE

(75) Inventor: Dean R. Devolpi, Incline Village, NV (US)

(73) Assignee: Varatouch Technology Incorporated, Scaramento, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/139,796

(22) Filed: Aug. 25, 1998

(51) Int. Cl.[7] ..... H01C 10/00

(52) U.S. Cl. ..... 345/161; 345/156; 345/163; 345/167; 345/168

(58) Field of Search ..... 345/161, 156, 345/163, 167, 168

(56) References Cited

U.S. PATENT DOCUMENTS

| | | | | |
|---|---|---|---|---|
| 4,493,219 | | 1/1985 | Sharp et al. | 73/862.05 |
| 5,473,126 | | 12/1995 | Wu | 200/64 |
| 5,488,206 | | 1/1996 | Wu | 200/6 A |
| 5,555,004 | * | 9/1996 | Ono et al. | 345/161 |
| 5,675,309 | | 10/1997 | DeVolpi | 338/68 |
| 5,828,363 | * | 10/1998 | Yaniger et al. | 345/156 |
| 5,912,612 | | 6/1999 | DeVolpi | 338/95 |
| 5,949,325 | * | 9/1999 | Devolpi | 338/154 |
| 6,043,806 | * | 3/2000 | Atwell | 345/161 |

OTHER PUBLICATIONS

U.S. application No. 08/939.377, Schrum et al., filed Sep. 29, 1997.

* cited by examiner

*Primary Examiner*—Bipin Shalwala
*Assistant Examiner*—Vincent E. Kovalick
(74) *Attorney, Agent, or Firm*—Townsend and Townsend and Crew LLP

(57) ABSTRACT

A joystick with improved performance, reliability and durability, that can be used as a cursor pointing device for computers, remote controls, web TV, TV guide browsers, VCR's video games, consumer electronics, industrial controllers, medical, automotive and other applications. An uninterrupted conductive curved elastomeric transducer can be deflected to positions on an electrical medium that results in the generation of a speed and direction signal to be interpreted by low cost available circuitry including micro-controller.

20 Claims, 4 Drawing Sheets

UNINTERRUPTED CURVED DISC POINTING DEVICE

BACKGROUND OF THE INVENTION

1. Field of the Invention

This invention relates in general to joystick pointing devices and in particular to an improved pointing device.

2. Description of Related Art

Joysticks are known in the art such as shown by DeVolpi U.S. Pat No. 5,675,309 entitled "Curved Disc Joystick Pointing Device", and copending CIP application thereof, Ser. No. 08/496,433, filed Oct. 6, 1997.

OBJECTS AND ADVANTAGES

Accordingly, several objects and advantages of my invention are that the uninterrupted curved disc pointing device can be assembled in mass production at a consistent quality and uniformity. Second, the amount of force needed to deflect is also reduced greatly giving increased user controllability as well as the added increased active PCB surface area for greater or maximum resolution.

Still further objects and advantages will become apparent from a consideration of the ensuing description and accompanying drawings.

SUMMARY OF THE INVENTION

It is an object of the present invention to provide an improved joystick pointing device that has the advantage of lower cost, higher reliability, and quicker and more accurate response with fewer parts.

The present invention comprises a pointing device with a combination of conductive contacts and resistive contacts on the substrate that cover the maximum surface area that the disc makes contact with when the disc has an external force applied. The disc will pivot and act like a movable fulcrum point.

Another feature of the present invention is to reduce the number of components that are a bottleneck for mass production and allow for production by automated machinery with high quality.

Other objects, features and advantages will be readily apparent from the following description of certain preferred embodiments thereof taken in conjunction with the accompanying drawings although variations and modifications may be effected without departing from the spirit and scope of the novel concepts of the disclosure.

DESCRIPTION OF THE PREFERRED EMBODIMENT

The invention comprises a joystick pointing device which uses a board such as a printed circuit board, glass, paper, ceramic or plastics which have conductive lines and resistive coatings formed on it or embedded or likewise provided on the surface. The board does not have a hole for the spring to pivot in. The conductive disc is held in place by the rubber return mechanism. If the joystick has force applied the resultant force causes a tilting action on the solid disc. This conductive disc makes contact on the PCB in 360 degrees thereby making contact on different parts of the PCB where there are conductive/resistive tracts. The contact on the PCB produces a variable current thereby causing a RC timing constant that can be interpreted by a simple timing loop of a microcontroller. In turn the microcontroller can interpret this data and correspondingly cause an output in speed and direction.

Figure 1:
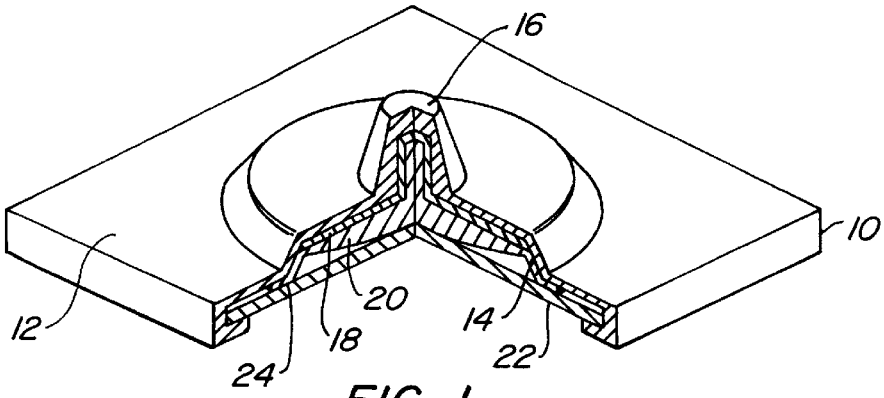
FIG. 1 is a perspective view of my invention with a plastic cap inserted for rigidity.

FIG. 1 is a perspective view showing the elements of an assembled module 10 which consists of the following basic parts. The outside is made of non-conductive elastomer 12. The non-conductive elastomer 12 has a mechanical return slope 14 built into it. The joystick 16 is also made with the non-conductive elastomer 12. Underneath the nonconductive elastomer 12 is a rigid cap 18 that covers the electrically conductive contiguous uninterrupted curved disc 20 that rests above the top of the PCB 22. A conductive leg 24 rests on the surface and makes electrical contact with the PCB 22.

Figure 2:
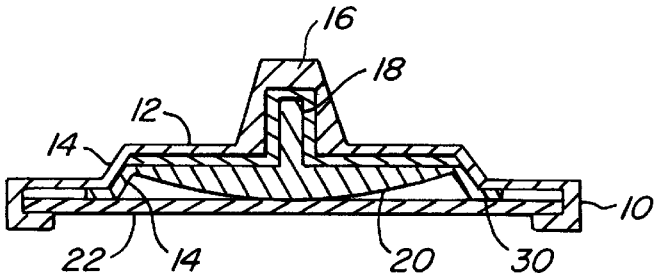
FIG. 2 is a cross section view of my invention including a plastic cap.

FIG. 2 shows a cross section view whereby the PCB 22 has an electrically conductive contiguous uninterrupted curved disc 20 on its surface and the electrically conductive contiguous uninterrupted curved disc 20 is held in place by the rigid cap 18 and the nonconductive elastomer 12 that has the mechanical return slope 14 built into it. The electrically conductive contiguous uninterrupted curved disc 20 has an electrically conductive leg 24 that makes contact on the surface of the PCB 22 thereby making electrical connection at contact area 30.

Figure 3:
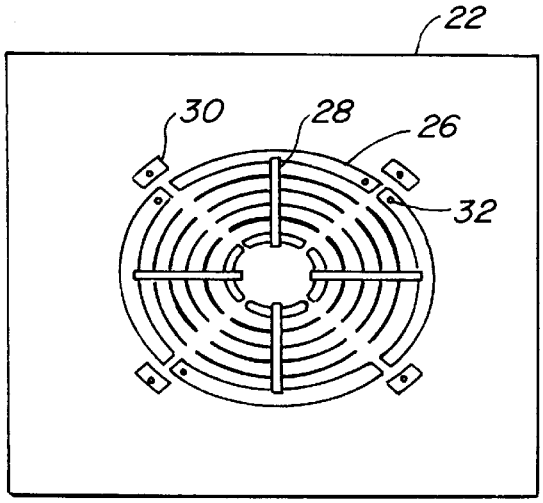
FIG. 3 is a detail of the top side of the PCB.

FIG. 3 is the detail of the top of the PCB 22. The PCB 22 has highly conductive traces 26 that surround the center as well as resistive elements 28 that connect the highly conductive traces 26. There is at least one contact area 30 on the PCB 22 where the electrically conductive leg 24 makes electrical contact with the PCB 22. The PCB 22 has vias 32 that electrically connect the top and bottom of the PCB 22.

Figure 4:
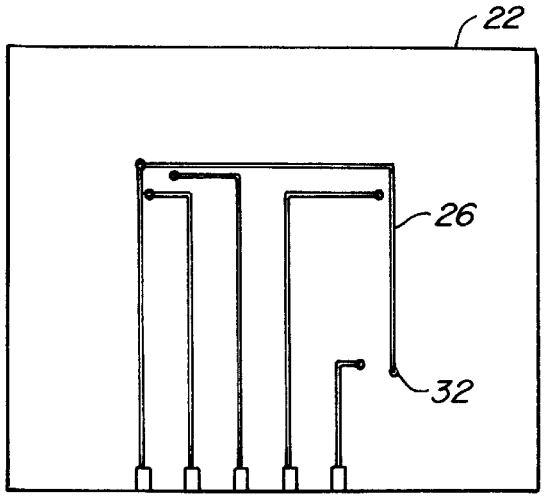
FIG. 4 is a detail view of the bottom of the PCB.

FIG. 4 is the detail of the bottom of the PCB 22 whereby the vias 32 have various highly conductive traces 26 to pass the variable electrical signal on without degrading the signal.

Figure 5:
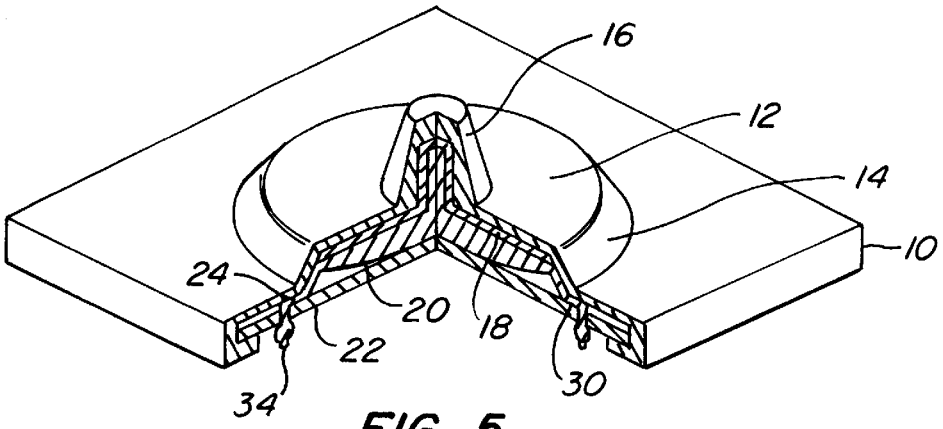
FIG. 5 is a perspective view of my invention with pull through tabs.

FIG. 5 is a perspective view showing the elements of an assembled module 10 which consists of the following basic parts. The outside is made of non-conductive elastomer 12. The non-conductive elastomer 12 has a mechanical return slope 14 built into it. The joystick 16 is also made with the non-conductive elastomer 12. Underneath the nonconductive elastomer 12 is a rigid cap 18 that covers the electrically conductive contiguous uninterrupted curved disc 20 that rests above the top of the PCB 22. There is a pull through tab 34 that is attached to the electrically conductive leg 24 of the electrically conductive contiguous uninterrupted curved disc 20 to provide electrical connection to the contact area 30 of the PCB 22.

Figure 6:
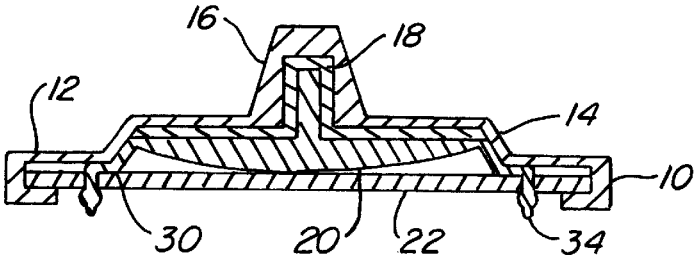
FIG. 6 is a cross section view of my invention with tabs that protrude through the PCB.

FIG. 6 shows a cross section view whereby the PCB 22 has an electrically conductive contiguous uninterrupted curved disc 20 on its surface and the electrically conductive contiguous uninterrupted curved disc 20 is held in place by the rigid cap 18 and the nonconductive elastomer 12 that has the mechanical return slope 14 built into it. The electrically conductive contiguous uninterrupted curved disc 20 has an electrically conductive leg 24 and a pull through tab 34 that makes contact on the surface of the PCB 22 thereby making electrical connection.

Figure 7:
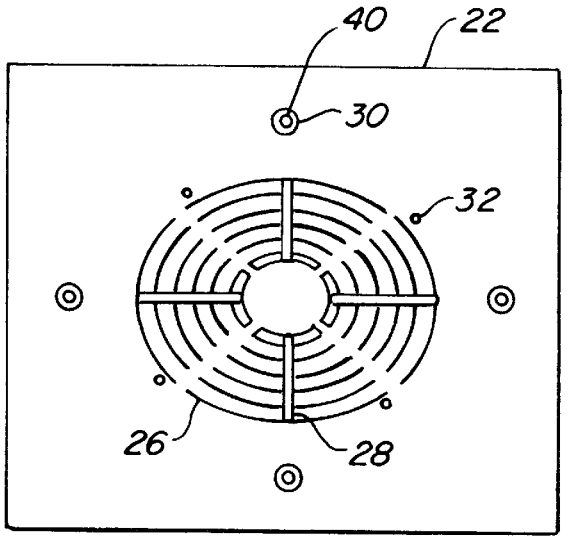
FIG. 7 is a view of the top side of the PCB with the tab pull through holes.

FIG. 7 is the detail of the top of the PCB 22. The PCB 22 has highly conductive traces 26 that surround the center as well as resistive elements 28 that connect the highly conductive traces 26. There is at least one contact area 30 on the PCB 22 where the electrically conductive leg 24 makes electrical contact with the PCB 22. The PCB 22 has vias 32 that electrically connect the top and bottom of the PCB 22. There are holes 40 in the PCB 22 for the pull through tab 34 to be pulled through.

Figure 8:
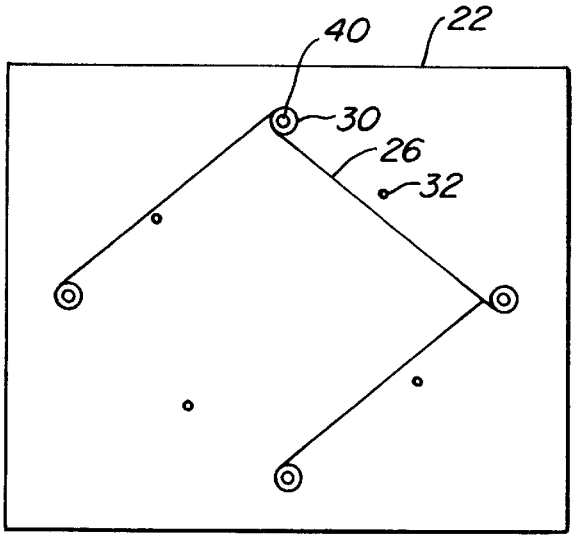
FIG. 8 is a view of the bottom of the PCB with holes for the pull through tab.

FIG. 8 is the detail of the bottom of the PCB 22 whereby the vias 32 have various highly conductive traces 26 to pass the variable electrical signal on without degrading the signal. There are also larger holes 40 in the PCB 22 for the pull through tab 34 to be pulled through.

Figure 9:
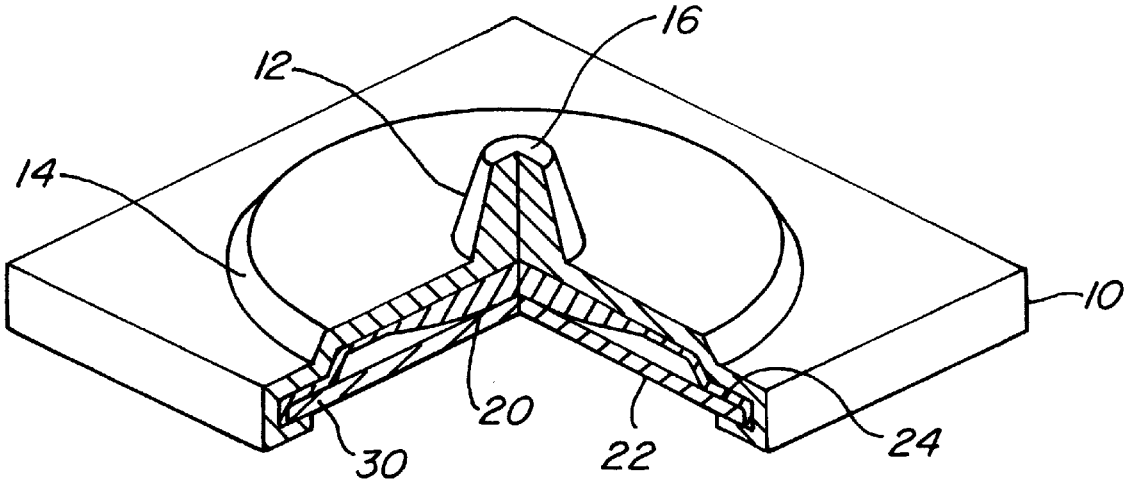
FIG. 9 is a perspective view of my invention without the rigid insert.

FIG. 9 is a perspective view showing the elements of an assembled module 10 which consists of the following basic parts. The outside is made of non-conductive elastomer 12. The non-conductive elastomer 12 has a mechanical return slope 14 built into it. The joystick 16 is also made with the non-conductive elastomer 12. Underneath the nonconductive elastomer 12 is an electrically conductive contiguous uninterrupted curved disc 20 that rests above the top of the PCB 22.

Figure 10:
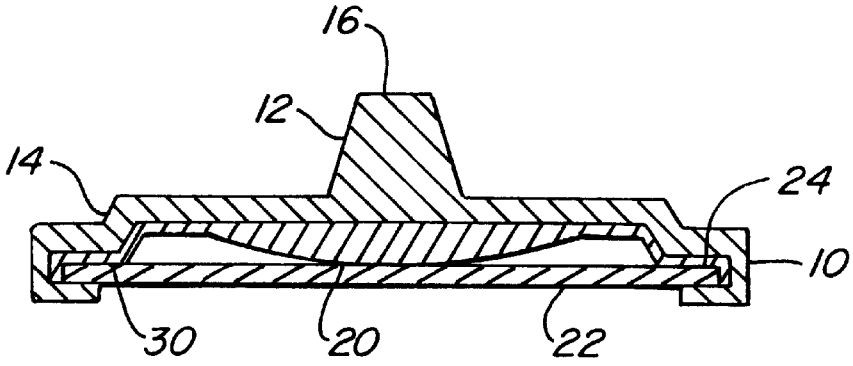
FIG. 10 is a cross section of the invention without the rigid insert.

FIG. 10 shows a cross section view whereby the PCB 22 has an electrically conductive contiguous uninterrupted curved disc 20 on its surface and the electrically conductive contiguous uninterrupted curved disc 20 is held in place by the non-conductive elastomer 12 that has the mechanical return slope 14 built into it. The electrically conductive contiguous uninterrupted curved disc 20 has an electrically conductive leg 24 that makes contact on the surface of the PCB 22 thereby making electrical connection.

The assembled module 10 is in a static position when no external forces are applied. In the static or in a non static position the leg electrically conductive leg 24 makes contact with the PCB 22 at the contact area 30. The result of the contact is that the electrically conductive contiguous uninterrupted curved disc 20 is always electrically active all over the continuous surface of the electrically conductive contiguous uninterrupted curved disc 20. When an external force is applied to the joystick 16 through the non-conductive elastomer 12 a resultant force causes a displacement of the mechanical return slope 14 through the joystick 16 directly. As the mechanical return slope 14 changes this kinetic energy into potential energy the electrically conductive contiguous uninterrupted curved disc 20 is pivoting on the PCB 22 which in turn changes the path of the electrical signal on the resistive elements 28 and the highly conductive traces 26. This signal is sent to external circuitry through the vias 32 and pull through tab 34 from the contact area 30 touching the electrically conductive leg 24. This signal is interpreted using any available A/D or RC timing circuit into direction and speed vectors.

Upon removing the force applied the potential energy stored in the mechanical return slope 14 causes the joystick 16 to return to its undeflected position.

CONCLUSIONS, RAMIFICATIONS, AND SCOPE

Accordingly, it can be seen that use of electrically conductive contiguous uninterrupted curved disc 20 without using a spring or protrusion in the center has the advantage of greater active surface area, fewer parts that translates into higher reliability, greater accuracy and lower costs.

Figure 11:
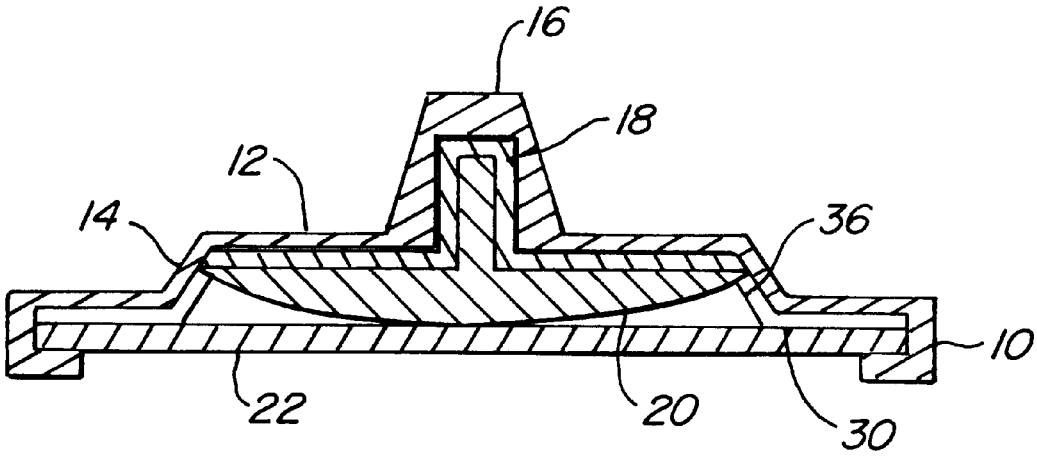
FIG. 11 is a cross section of my invention with a conductive wire.
Figure 12:
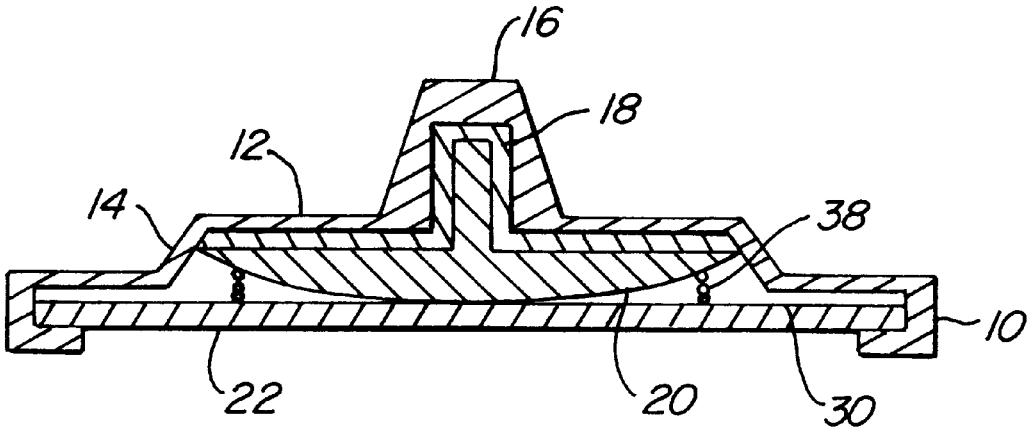
FIG. 12 is a cross section of my invention with a conductive spring.

Although the description above contains many specificities, these should not be construed as limiting the scope of the invention but as merely providing illustrations of some of the presently preferred embodiments of this invention. Various other embodiments and ramifications are possible within it's scope. For example, there are several PCB layouts of highly conductive traces 26 and resistive elements 28 that can be used as well as several methods of making the electrically conductive contiguous uninterrupted curved disc 20 become a current source such as connecting a wire 36 (FIG. 11) or a spring 38 (FIG. 12) to it instead of having an electrically conductive leg 24, as well as several mechanical return slope 14 configurations not shown but are obvious.

Thus the scope of the invention should be determined by the appended claims and their legal equivalents, rather than by the examples given.

What is claimed is:

1. A joystick pointing device comprising:

a substrate having a surface coated with electrically conductive and electrically resistive coatings;

an electrically non-conductive stick connected with the substrate and including a mechanical return portion resiliently biasing the stick toward a rest position relative to the substrate;

an electrically conductive uninterrupted curved disc comprising a conductive elastomeric material, the disc being coupled to the stick and having a curved surface which is pivotable upon the surface of the substrate to change contact positions of the curved surface on the surface of the substrate causing electrical connection between the disc and the conductive and resistive coatings on the surface of the substrate upon application of an external force on the stick, the mechanical return portion of the stick biasing and returning the disc to a static position upon removal of the external force; and a pull through tab connected to an electrically conductive leg of the disc to provide electrical connection to the substrate.

2. The joystick pointing device of claim 1 comprising a plurality of pull through tabs connected between the electrically conductive leg of the disc and the substrate.

3. The joystick pointing device of claim 2 comprising four pull through tabs connected between the electrically conductive leg of the disc and the substrate.

4. The joystick pointing device of claim 3 wherein the four pull through tabs are evenly spaced around an outer boundary of the disc.

5. The joystick pointing device of claim 1 wherein the pull through tab comprises a conductive elastomeric material.

6. The joystick pointing device of claim 1 further comprising a rigid member disposed between the disc and the electrically non-conductive stick.

7. The joystick pointing device of claim 1 wherein the mechanical return portion comprises a slope.

8. A joystick pointing device comprising:

a substrate having a surface coated with electrically conductive and electrically resistive coatings;

an electrically non-conductive stick connected with the substrate and including a mechanical return portion resiliently biasing the stick toward a rest position relative to the substrate;

an electrically conductive uninterrupted curved disc comprising a conductive elastomeric material, the disc being coupled to the stick and having a curved surface which is pivotable upon the surface of the substrate to change contact positions on the surface of the substrate causing electrical connection between the disc and the conductive and resistive coatings on the surface of the substrate upon application of an external force on the stick, the mechanical return portion of the stick biasing and returning the disc to a static position upon removal of the external force, the curved disc including an outer boundary surrounding the curved surface; and a member electrically connected between the substrate and the disc adjacent the outer boundary to transfer a current from the substrate to the disc adjacent the outer boundary of the disc.

9. The joystick pointing device of claim 8 wherein the member is electrically connected to the disc at a plurality of locations adjacent the outer boundary.

10. The joystick pointing device of claim 9 wherein the member is electrically connected to the disc at four locations adjacent the outer boundary.

11. The joystick pointing device of claim 10 wherein the four locations are evenly spaced around the outer boundary of the disc.

12. The joystick pointing device of claim 8 wherein the member comprises at least one wire, spring, or sheet.

13. The joystick pointing device of claim 8 wherein the member comprises an annular member electrically connected to the entire outer boundary of the disc.

14. The joystick pointing device of claim 8 wherein the member comprises at least one pull through tab attached to the disc to provide electrical connection to the substrate.

15. The joystick pointing device of claim 8 wherein the member comprises a conductive elastomeric material.

16. The joystick pointing device of claim 8 further comprising a rigid member disposed between the disc and the electrically non-conductive stick.

17. The joystick pointing device of claim 8 wherein the mechanical return portion comprises a slope.

18. A joystick pointing device comprising:

a substrate having a surface coated with electrically resistive coatings;

an electrically non-conductive stick connected with the substrate and including a mechanical return portion resiliently biasing the stick toward a rest position relative to the substrate;

an electrically conductive uninterrupted curved disc comprising a conductive elastomeric material, the disc being coupled to the stick and having a curved surface which is pivotable upon the surface of the substrate to change contact positions on the surface of the substrate causing electrical connection between the conductive disc and the resistive coatings on the surface of the substrate upon application of an external force on the stick, the mechanical return portion of the stick biasing and returning the disc to a static position upon removal of the external force, the curved disc including an outer boundary surrounding the curved surface; and at least one member electrically connected between the substrate and the disc adjacent the outer boundary to transfer a current from the substrate to the disc adjacent the outer boundary of the disc.

19. The joystick pointing device of claim 18 wherein the member comprises a wire, spring, or sheet.

20. The joystick pointing device of claim 18 wherein the member comprises an annular member electrically connected to the entire outer boundary of the disc.

* * * * *